US007438194B2

(12) United States Patent
Wang

(10) Patent No.: US 7,438,194 B2
(45) Date of Patent: Oct. 21, 2008

(54) ORGANIZER

(76) Inventor: Wen-Tsan Wang, PO Box 82-144, Taipei (TW)

( * ) Notice: Subject to any disclaimer, the term of this patent is extended or adjusted under 35 U.S.C. 154(b) by 62 days.

(21) Appl. No.: 10/345,270

(22) Filed: Jan. 16, 2003

(65) Prior Publication Data

US 2004/0140282 A1 Jul. 22, 2004

(51) Int. Cl.
*A47F 5/08* (2006.01)

(52) U.S. Cl. ..... 211/113

(58) Field of Classification Search ..... 211/113, 211/119.004, 115, 117, 118, 85.2, 85.3, 10, 211/55; 312/3, 6

See application file for complete search history.

(56) References Cited

U.S. PATENT DOCUMENTS

| | | | | | |
|---|---|---|---|---|---|
| 962,595 | A | * | 6/1910 | Smith | 211/88.01 |
| 2,165,869 | A | * | 7/1939 | Mathiesen | 383/23 |
| 3,023,907 | A | * | 3/1962 | Ross | 211/55 |
| D256,636 | S | * | 9/1980 | Leishman | D6/315 |
| D299,895 | S | * | 2/1989 | Converti | D6/514 |
| D300,399 | S | * | 3/1989 | Krugman | D6/553 |
| D312,727 | S | * | 12/1990 | Kunewalder | D6/512 |
| D313,524 | S | * | 1/1991 | Barnes | D6/553 |
| D337,467 | S | * | 7/1993 | Schmidt | D6/570 |
| 5,295,587 | A | * | 3/1994 | Downes et al. | 211/85.2 |
| 5,370,246 | A | * | 12/1994 | Traynor | 211/86.01 |
| D355,085 | S | * | 2/1995 | Wilhite et al. | D6/514 |
| 5,462,178 | A | * | 10/1995 | Wallach et al. | 211/163 |
| 5,477,967 | A | * | 12/1995 | Voorhees et al. | 211/88.01 |
| 5,692,604 | A | * | 12/1997 | Houk | 206/278 |
| 5,779,033 | A | * | 7/1998 | Roegner | 206/6.1 |
| 6,006,929 | A | * | 12/1999 | Leonard | 211/113 |
| 6,158,593 | A | * | 12/2000 | Olsen | 211/113 |
| 6,390,573 | B1 | * | 5/2002 | Wang | 312/6 |
| 6,536,590 | B1 | * | 3/2003 | Godshaw et al. | 206/373 |
| 6,659,273 | B1 | * | 12/2003 | Scola | 206/285 |
| D566,986 | S | * | 4/2008 | Greiner | D6/411 |
| 2002/0092785 | A1 | * | 7/2002 | Lungo | 206/373 |
| 2005/0189388 | A1 | * | 9/2005 | Godshaw et al. | 224/607 |
| 2005/0230336 | A1 | * | 10/2005 | Mundy et al. | 211/113 |
| 2006/0049124 | A1 | * | 3/2006 | Wang | 211/113 |
| 2006/0219587 | A1 | * | 10/2006 | Redzisz et al. | 206/373 |

* cited by examiner

*Primary Examiner*—Jennifer E. Novosad
(74) *Attorney, Agent, or Firm*—Leong C. Lei

(57) ABSTRACT

An organizer is constructed to include a base panel, a plurality of top-open pockets located on the outer wall of the base panel for keeping things, Each top-open pocket has a top hem and a resilient metal wire rod hemmed in the top hem to support the respective top-open pocket in shape. A bottom-open pocket is provided at the inner wall of the base panel near the top, the bottom-open pocket having a plurality of through holes in the closed top side, and a hanger is fastened to the bottom-open pocket for hanging the base panel on a support. The hanger has a mounting board fitted into the bottom-open pocket and a plurality of hooks respectively extended out of the through holes of the bottom-open pocket for hanging.

1 Claim, 7 Drawing Sheets

ORGANIZER

BACKGROUND OF THE INVENTION

1. Field of the Invention

The present invention relates to organizers for hanging on the wall or a support for keeping books, magazines, newspapers, or any of a variety of small items and, more specifically, to a flexible organizer, which comprises a fabric base panel, a plurality of top-open pockets provided at the outer wall of the base panel for keeping things, and a hanger fastened to the base panel at the top for hanging.

2. Description of the Related Art

Organizers are commonly used at home or in offices for keeping books, magazines, newspapers, and other accessories and small items. A wall mounting type organizer is known comprising a base panel made of canvas or the like, a plurality of pockets provided at the front (outer) wall of the base panel for keeping things, and hooks respectively fastened to the base panel at the top for hanging. The pockets are made of canvas or the like, and respectively fastened to the base panel with stitches. Because the pockets are made of flexible material, the user needs to pull the pockets into an open status before storing things. The hooks are directly fastened to respective through holes in the base panel near the top side. Because the hooks are not well shielded, their installation destroys the sense of beauty of the organizer. Furthermore, this structure of wall mounting type is designed for hanging on the wall or a high place, not suitable for placing on the floor.

SUMMARY OF THE INVENTION

The present invention has been accomplished under the circumstances in view. It is one object of the present invention to provide an organizer, which keeps the pockets open for easy loading of storage items. It is another object of the present invention to provide an organizer, which has the hanging hooks well shielded, so as not to destroy the sense of beauty of the whole structure. It is still another object of the present invention to provide an organizer, which can be supported on the floor. According to one aspect of the present invention, the organizer comprises a base panel, a plurality of top-open pockets located on the front (outer) wall of the base panel for keeping things, each top-open pocket having a top hem and a resilient metal wire rod hemmed in the top hem to support the respective top-open pocket in the open status, and a hanger fastened to the base panel at the top side for hanging. According to another aspect of the present invention, the base panel has a bottom-open pocket provided at the back (inner) wall of the base panel near the top, the bottom-open pocket having a plurality of through holes in the closed top side; the hanger comprises a mounting board fitted into the bottom-open pocket at the base panel, and a plurality of hooks respectively extended our of the through holes of the bottom-open pocket for hanging. According to an alternate form of the present invention, the base panel is arranged into a three-dimensional profile and held in shape by a support frame, and a rotary stand is fastened to the bottom end of the base panel for supporting the three-dimensional base panel on a flat surface.

DETAILED DESCRIPTION OF THE PREFERRED EMBODIMENT

Figure 1:
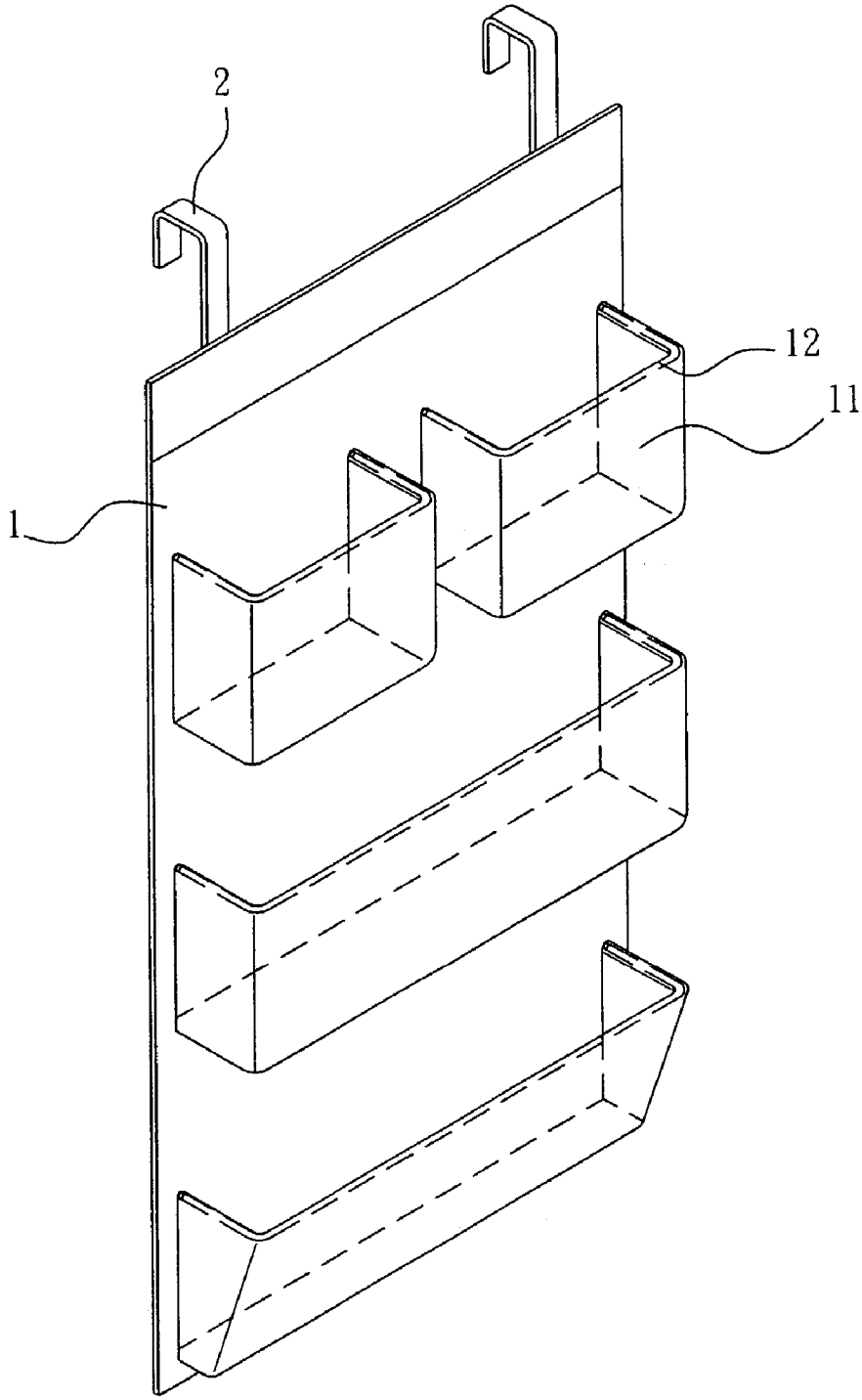
FIG. 1 is a perspective view of an organizer according to one embodiment of the present invention.

Referring to FIG. 1, an organizer is shown in accordance with one embodiment of the present invention, comprising a base panel 1, a plurality of hooks 2 provided at the top side of the base panel 1 for hanging, and a plurality of top-open pockets 11 respectively provided at the front side of the base panel 1 for keeping books, magazines, newspaper, etc. Each pocket 11 has the periphery of the top open side reinforced with a resilient metal wire rod 12. The resilient metal wire rod 12 holds the respective pocket 11 in shape. The base panel 1 is preferably made of strong coarse cloth, for example, canvas. The pockets 11 have different sizes for keeping different items.

Figure 2:
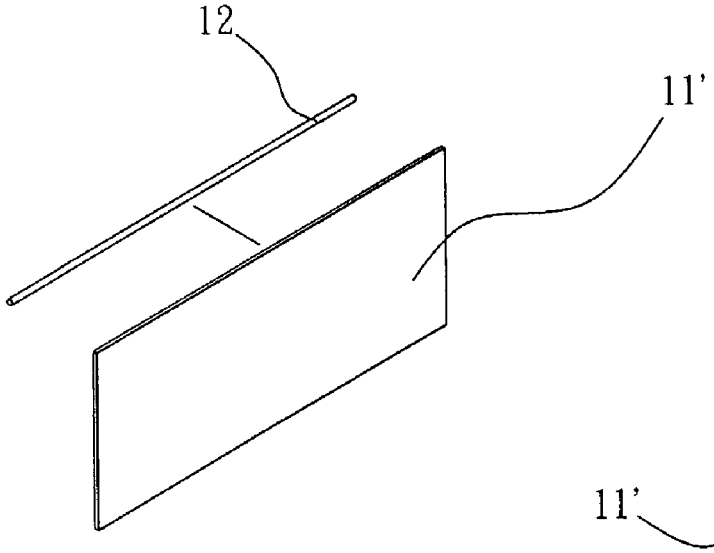
FIG. 2 is an exploded view of a sheet material and a resilient metal wire rod for a pocket according to the present invention.
Figure 3:
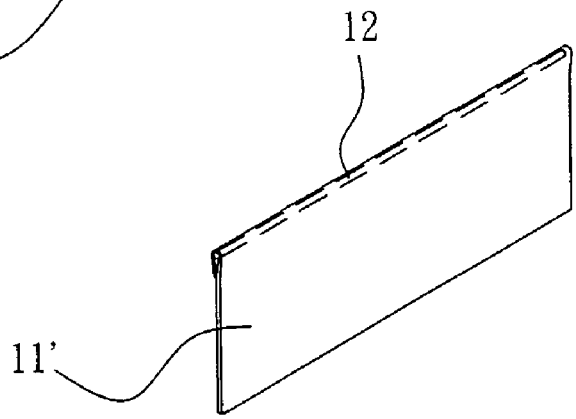
FIG. 3 is a perspective assembly view of FIG. 2.
Figure 4:
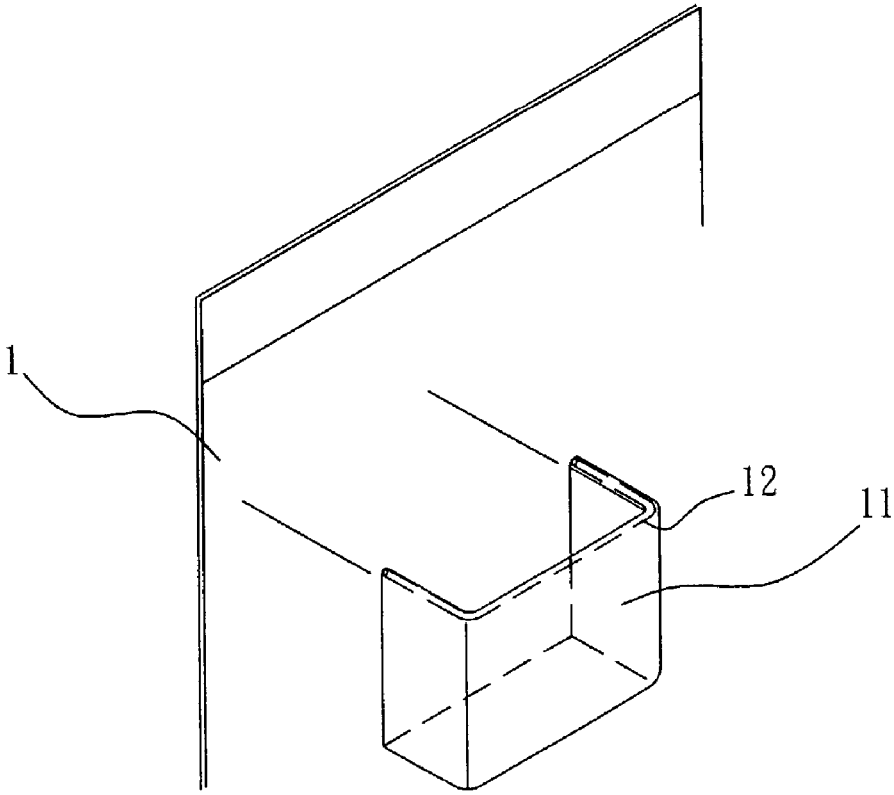
FIG. 4 is an exploded view of a part of the organizer according to the present invention, showing the hemmed resilient metal wire rod bent with the hem of the sheet material into the desired shape.

Referring to FIGS. 2~4 and FIG. 1 again, each pocket 11 is comprised of a sheet material 11' and a resilient metal wire rod 12 (see FIG. 2). One side edge of the sheet material 11' is folded over and sewn down to form a hem, keeping the resilient metal wire rod 12 hemmed in the hem (see FIG. 3). Thereafter, the resilient metal wire rod 12 is bent with the hem of the sheet material 11' into a U-shaped profile, and then the other side edges of the sheet material 11' are stitched to the base panel 1 (see FIG. 4 and FIG. 1). Preferably, the sheet material 11' is a piece of canvas.

Figure 5:
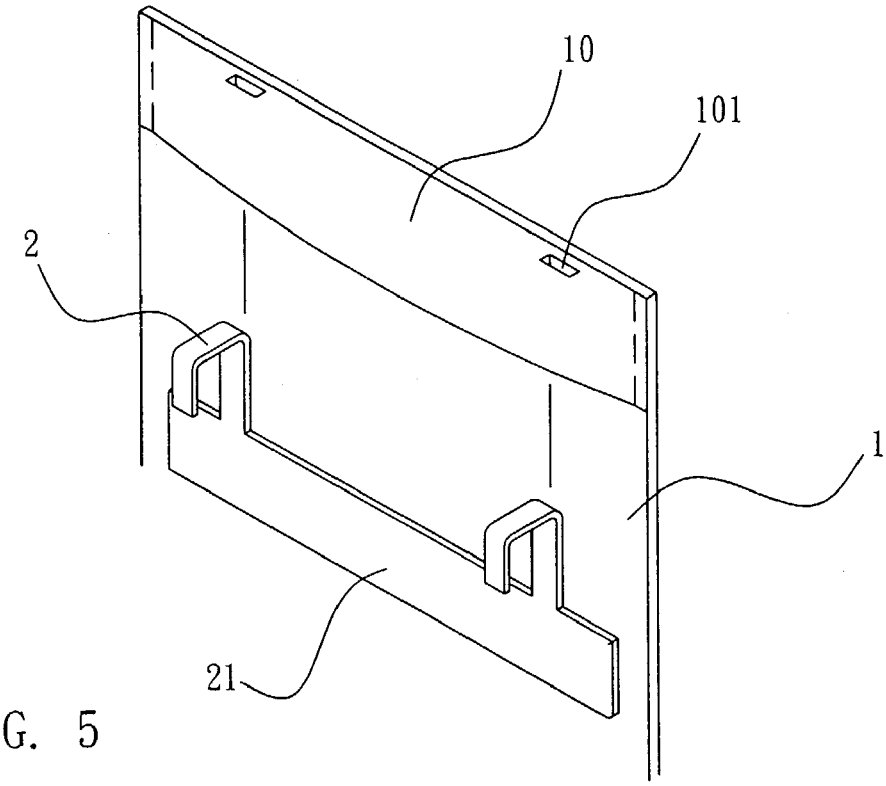
FIG. 5 is an exploded view of a part of the present invention, showing the back side structure of the organizer.
Figure 6:
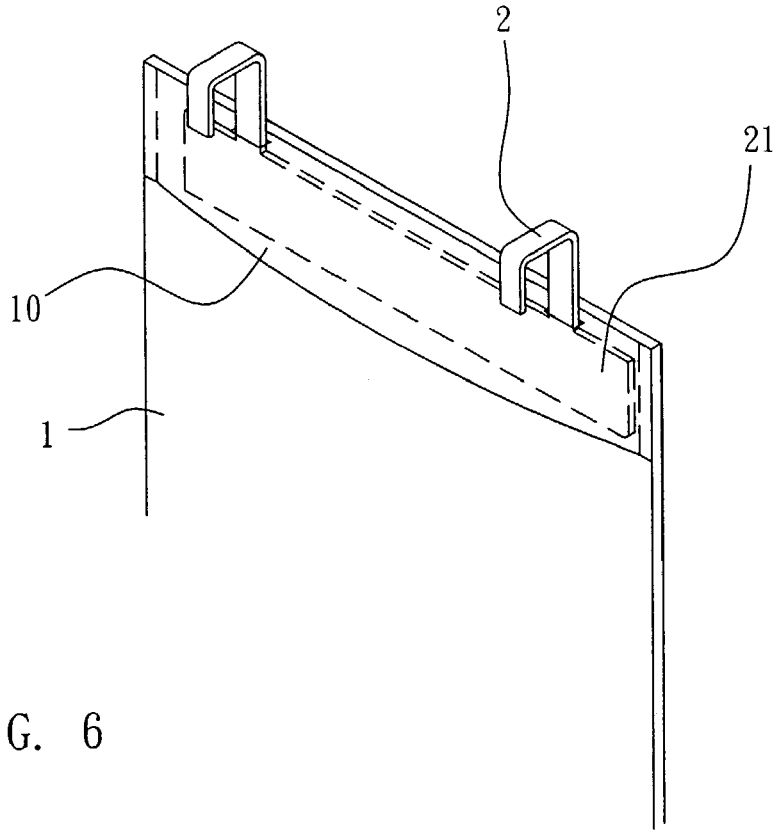
FIG. 6 is a perspective assembly view of FIG. 5.

With reference to FIGS. 5 and 6 and FIG. 1 again, the base panel 1 has a bottom-open pocket 10 located on the back side and extended along the topmost edge. The bottom-open pocket 10 has a plurality of through holes 101 in the close top side. The hooks 2 are formed integral with a mounting board 21. The mounting board 21 is put in the bottom-open pocket 10, keeping the hooks 2 respectively extended out of the bottom-open pocket 10 through the through holes 101 for hanging.

Figure 7:
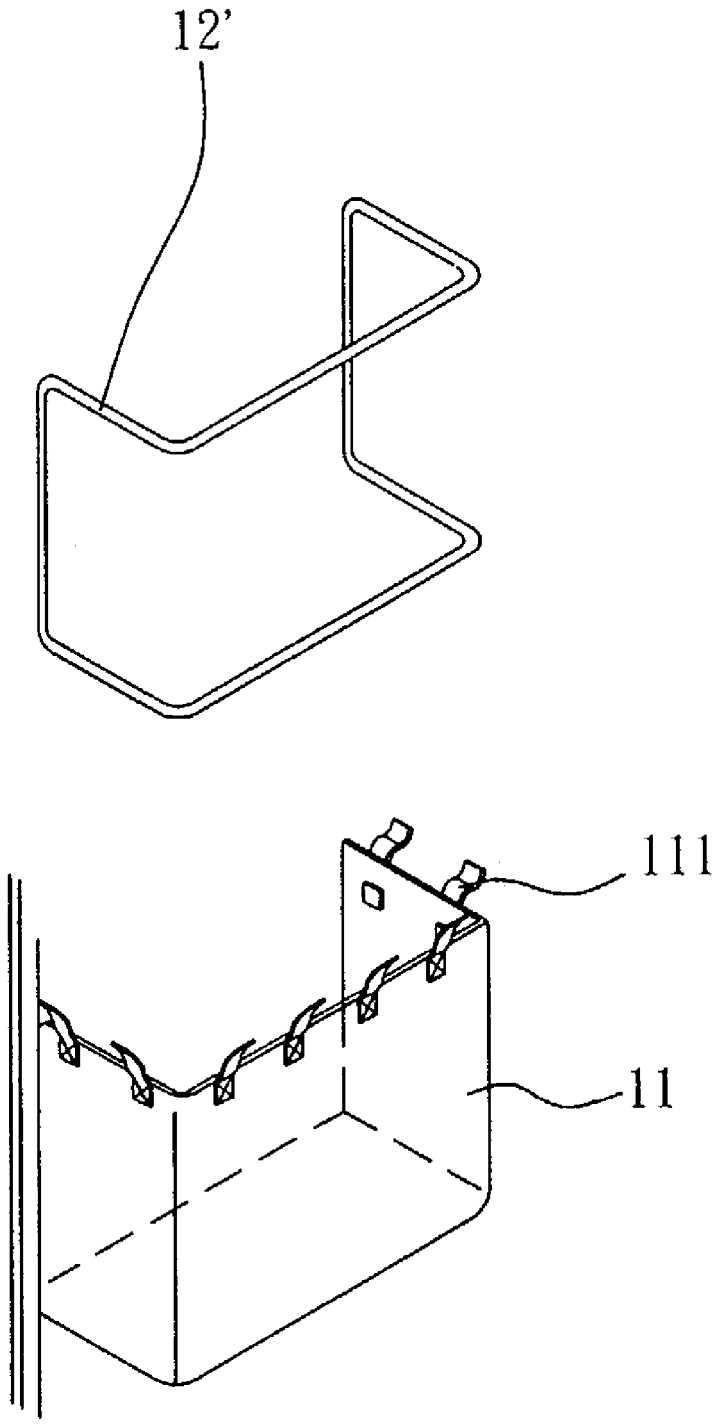
FIG. 7 is an exploded view of an alternate form of the top-open pocket for the organizer according to the present invention.

With reference to FIG. 7, the pocket 11 can be made having fastening elements 111 provided around the periphery of the top open side for securing a support frame 12' inside the pocket 11. The support frame 12' is formed of a resilient metal wire rod and bent into the desired shape for supporting the pocket 11 in shape. The fastening elements 111 can be made from hook and loop materials.

Figure 8:
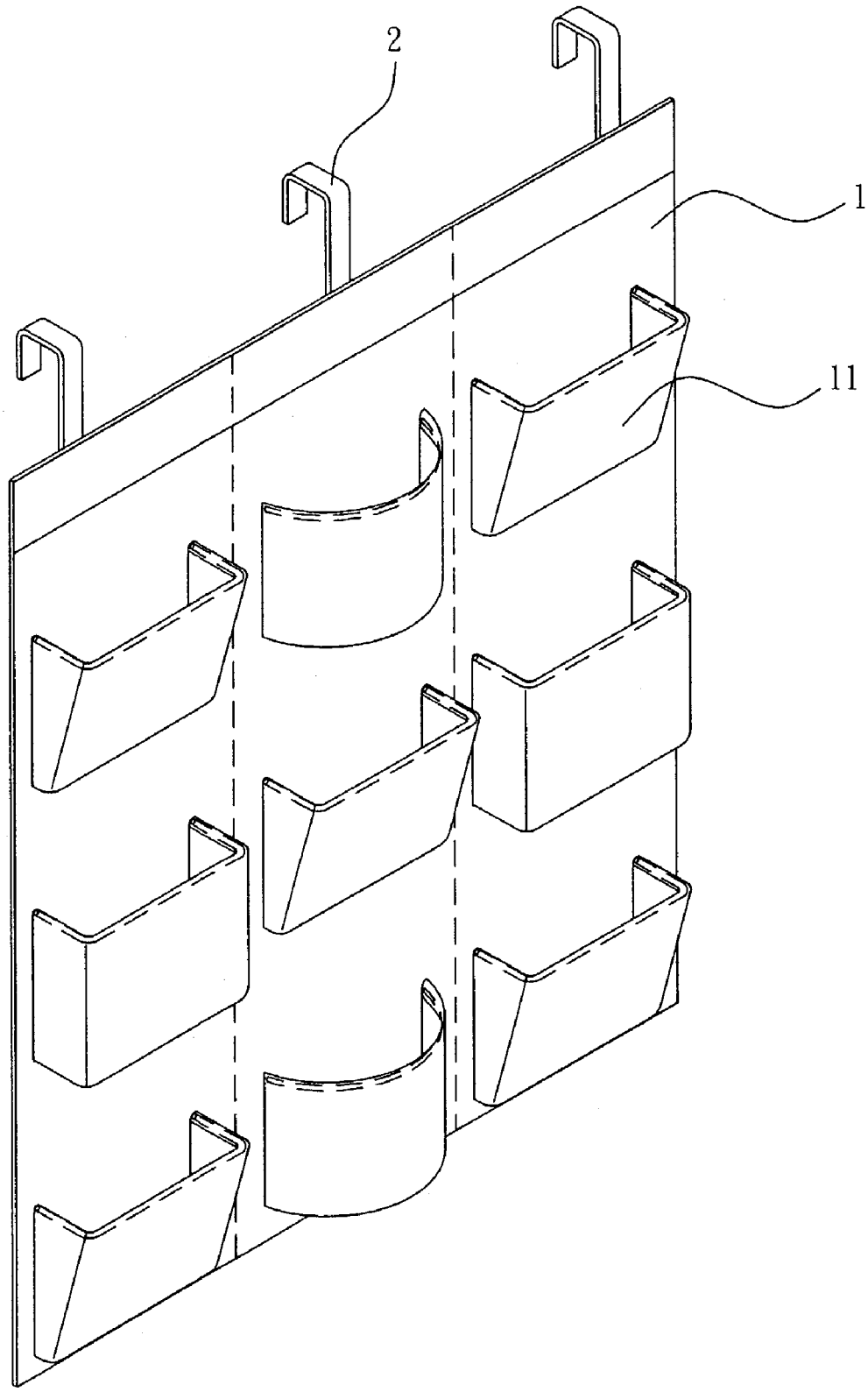
FIG. 8 is a perspective view of an alternate form of the organizer according to the present invention.

FIG. 8 shows an alternate form of the organizer. According to this alternate form, the base panel 1 is relatively bigger, and a plurality of top-open pockets 11 are provided at the front side of the base panel 1 and arranged into three rows.

Figure 9:
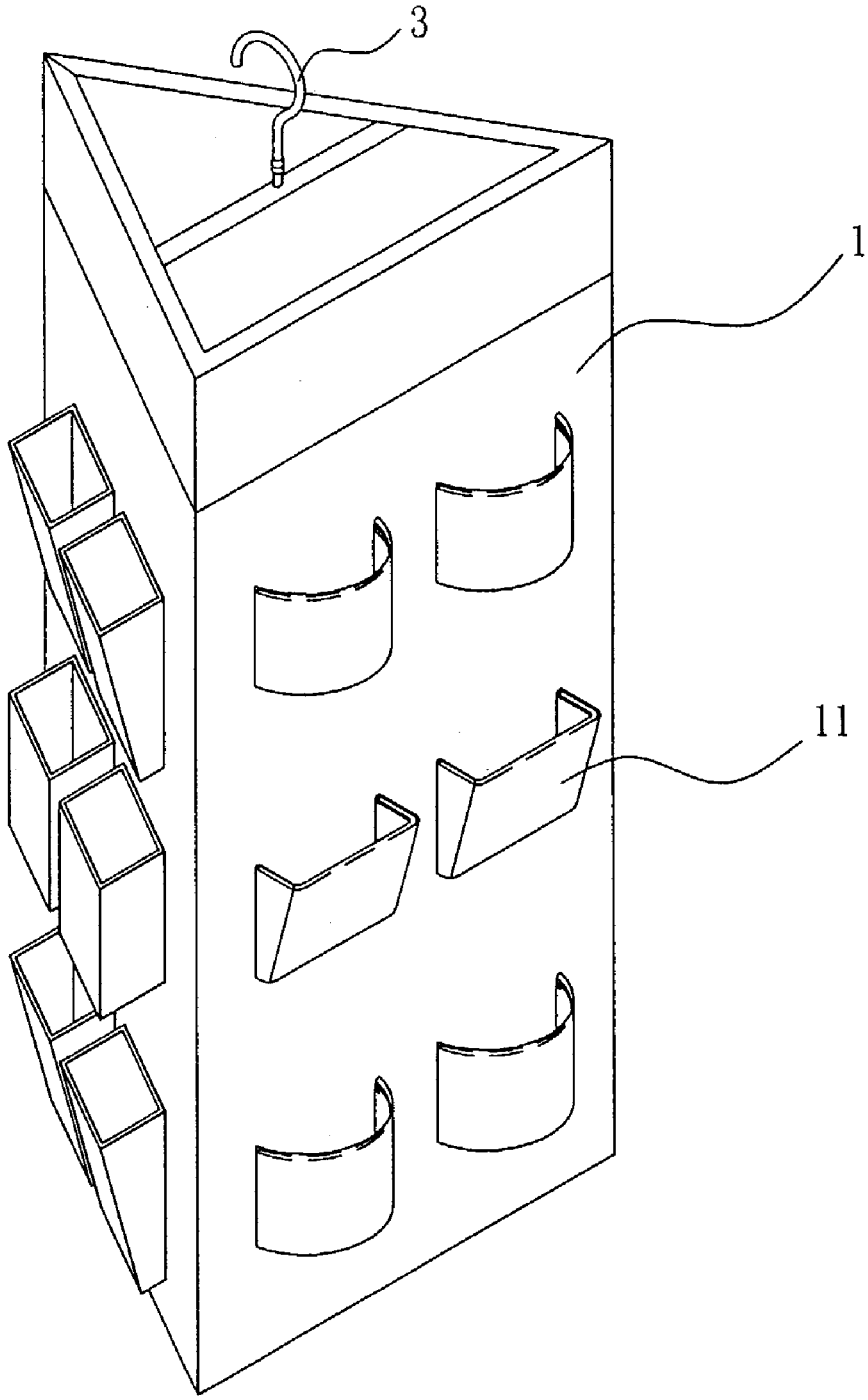
FIG. 9 is a perspective view of another alternate form of the organizer according to the present invention.

FIG. 9 shows another alternate form of the organizer. According to this embodiment, the organizer comprises a base panel 1 arranged into the shape of a triangular tube, a hanger 3 fixedly fastened to one end of the triangular tube of base panel 1 for hanging, and a plurality of top-open pockets 11 respectively provided at each of the three sides of the tubular base panel 1.

Figure 10:
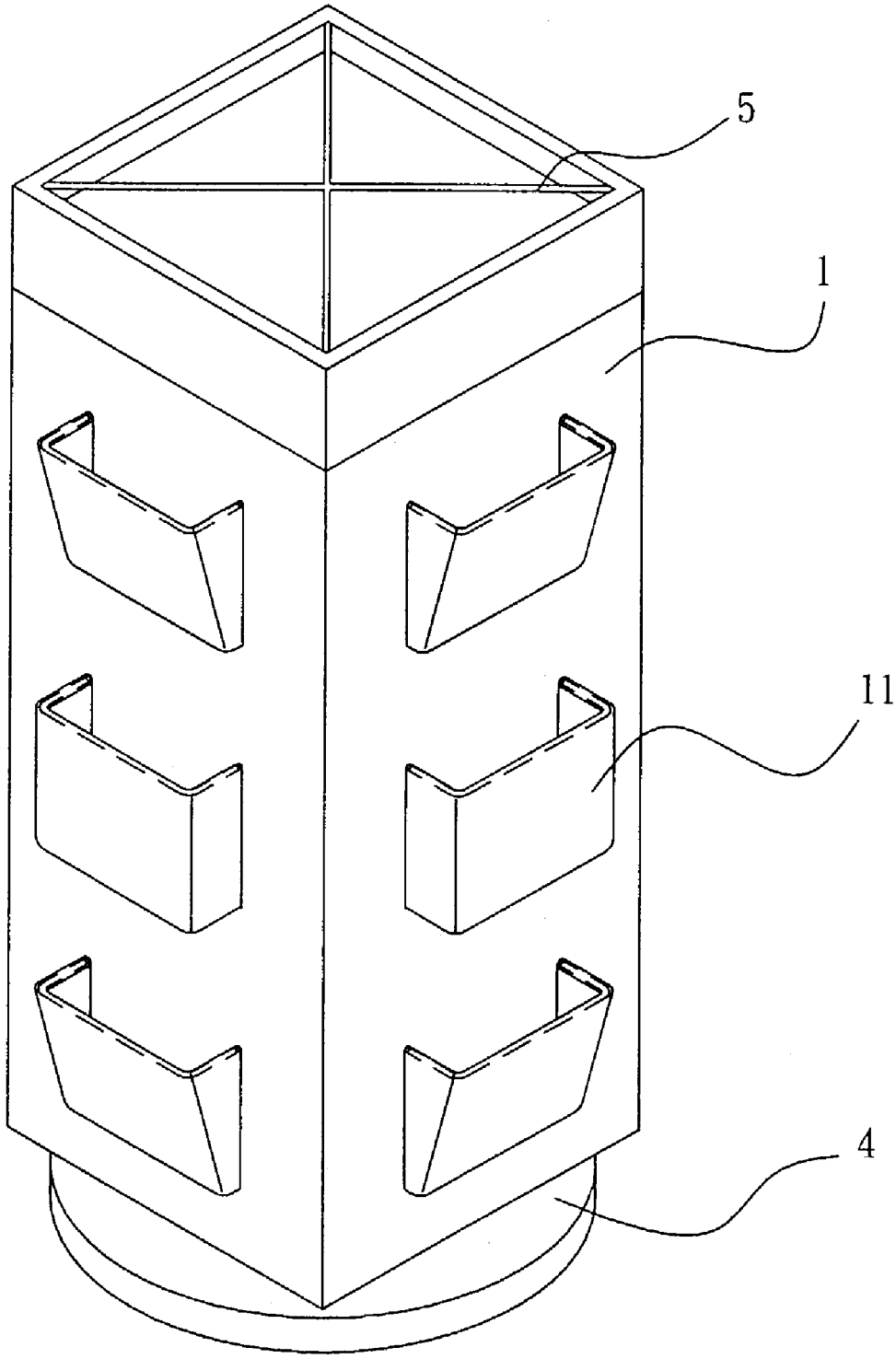
FIG. 10 is a perspective view of still another alternate form of the organizer according to the present invention.

FIG. 10 shows still another alternate form of the organizer. According to this embodiment, the organizer comprises a base panel 1 arranged into the shape of a rectangular tube, a rectangular support frame 5 fastened to the top end of the rectangular tube of base panel 1 to hold the rectangular tube of base panel 1 in shape, a plurality of top-open pockets 11 respectively provided at each of the four sides of the rectangular tube of base panel 1, and a rotary stand 4 fastened to the bottom end of the rectangular tube of base panel 1 for supporting organizer on the floor.

A prototype of organizer has been constructed with the features of FIGS. 1~10. The organizer functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An organizer comprising:

a base panel made of coarse cloth, said base panel having an end pocket with an opening facing downwards towards a bottom edge of said base panel and being located on a back side and extending along a topmost edge, said end pocket having a plurality of through holes in a top side thereof adjacent a top edge of said base panel, a plurality of hooks being formed integral with a mounting board, said mounting board inserted into said end pocket such that each of said plurality of hooks is inserted into a respective one of said through holes so that said hooks extend outwardly and upwardly from said through holes for hanging said organizer from a support; and a plurality of storage pockets having an open top and opening upwardly towards the top edge of the base panel and being attached on a front side of said base panel, said storage pockets defining different groupings with one grouping being of a different size than another of said groupings for keeping different items, each of said storage pockets being made from a sheet material and comprising a resilient metal wire rod, whereby one side edge of said sheet material is folded over a portion of said wire rod and sewn in place thereby forming a hem to retain the portion of the wire rod therein, said wire rod comprising bends to thereby form a support having a U-shaped profile, and at least three side edges of the sheet material being stitched to the front side of the base panel, to thereby form the respective storage pockets, whereby the U-shaped profile of the wire rod assists in providing rigidity to and maintaining the open top of said respective storage pocket.

* * * * *